US005584533A

United States Patent [19]

Schrewe

[11] Patent Number: 5,584,533

[45] Date of Patent: Dec. 17, 1996

[54] CHAIR WITH VARIABLE INCLINATION OF THE SEAT AND BACKREST

[75] Inventor: Klaus Schrewe, Brilon-Bontkirchen, Germany

[73] Assignee: Mauser Waldeck AG, Waldeck, Germany

[21] Appl. No.: 351,334

[22] PCT Filed: Apr. 9, 1994

[86] PCT No.: PCT/EP94/01105

§ 371 Date: Dec. 12, 1994

§ 102(e) Date: Dec. 12, 1994

[87] PCT Pub. No.: WO94/23614

PCT Pub. Date: Oct. 27, 1994

[30] Foreign Application Priority Data

Apr. 14, 1993 [DE] Germany ..... 43 12 113.6

[51] Int. Cl.[6] ..... A47C 3/025

[52] U.S. Cl. ..... 297/300.2; 297/300.6; 297/300.5; 297/300.4

[58] Field of Search ..... 297/301, 300.2, 297/300.5, 300.4, 300.6, 302.4

[56] References Cited

U.S. PATENT DOCUMENTS

| | | | |
|---|---|---|---|
| 3,402,964 | 9/1968 | Williams | 297/300.6 X |
| 4,411,469 | 10/1983 | Drabert et al. | 297/300.2 |
| 4,685,733 | 8/1987 | Machate et al. | 297/300.6 X |
| 4,707,029 | 11/1987 | Korn | 297/300.5 |
| 4,709,962 | 12/1987 | Steinmann | 297/300.5 X |
| 4,709,963 | 12/1987 | Decker et al. | 297/300.5 |
| 4,758,045 | 7/1988 | Edel et al. | 297/300.2 |
| 4,830,431 | 5/1989 | Inoue | 297/300.5 |
| 4,943,115 | 7/1990 | Stucki | 297/300.4 |
| 4,966,411 | 10/1990 | Katagari et al. | 297/300.5 X |
| 5,195,801 | 3/1993 | Franck et al. | 297/300.5 |
| 5,224,758 | 7/1993 | Takamatsu et al. | 297/300.5 |
| 5,308,144 | 5/1994 | Korn | 297/300.2 |
| 5,397,165 | 3/1995 | Grin et al. | 297/300.5 |
| 5,425,566 | 6/1995 | Buchacz | 297/301 |

*Primary Examiner*—Peter M. Cuomo
*Assistant Examiner*—Rodney B. White
*Attorney, Agent, or Firm*—Anderson, Kill & Olick P.C.

[57] ABSTRACT

The invention is directed to a seat arrangement with a seat pivotable around a horizontal pivot axis in its front region and with a variable inclination and with a backrest whose inclination can be changed compulsorily more than proportionally (super proportionally) in relationship to [or as a function of] the inclination change of the seat; herein the seat is pivotally connected to rocking levers. The rocking levers support the backrest with their respective ends. The respective ends of the rocking levers, opposite to the respective backrest supporting ends, are pivotally attached to the bearing block of the seat frame, wherein the rocking levers are articulated at the seat with spacing from the rear end of said seat and where the segments of the rocking levers rotatably supported in the bearing block and the segments of the rocking levers adjacent to the articulation axis of the seats form an obtuse angle with the base, wherein a return spring is provided for automatic return of the seat surface and backrest from the neutral into the working position if the weight is removed from the seat.

4 Claims, 5 Drawing Sheets

CHAIR WITH VARIABLE INCLINATION OF THE SEAT AND BACKREST

Figure 1:
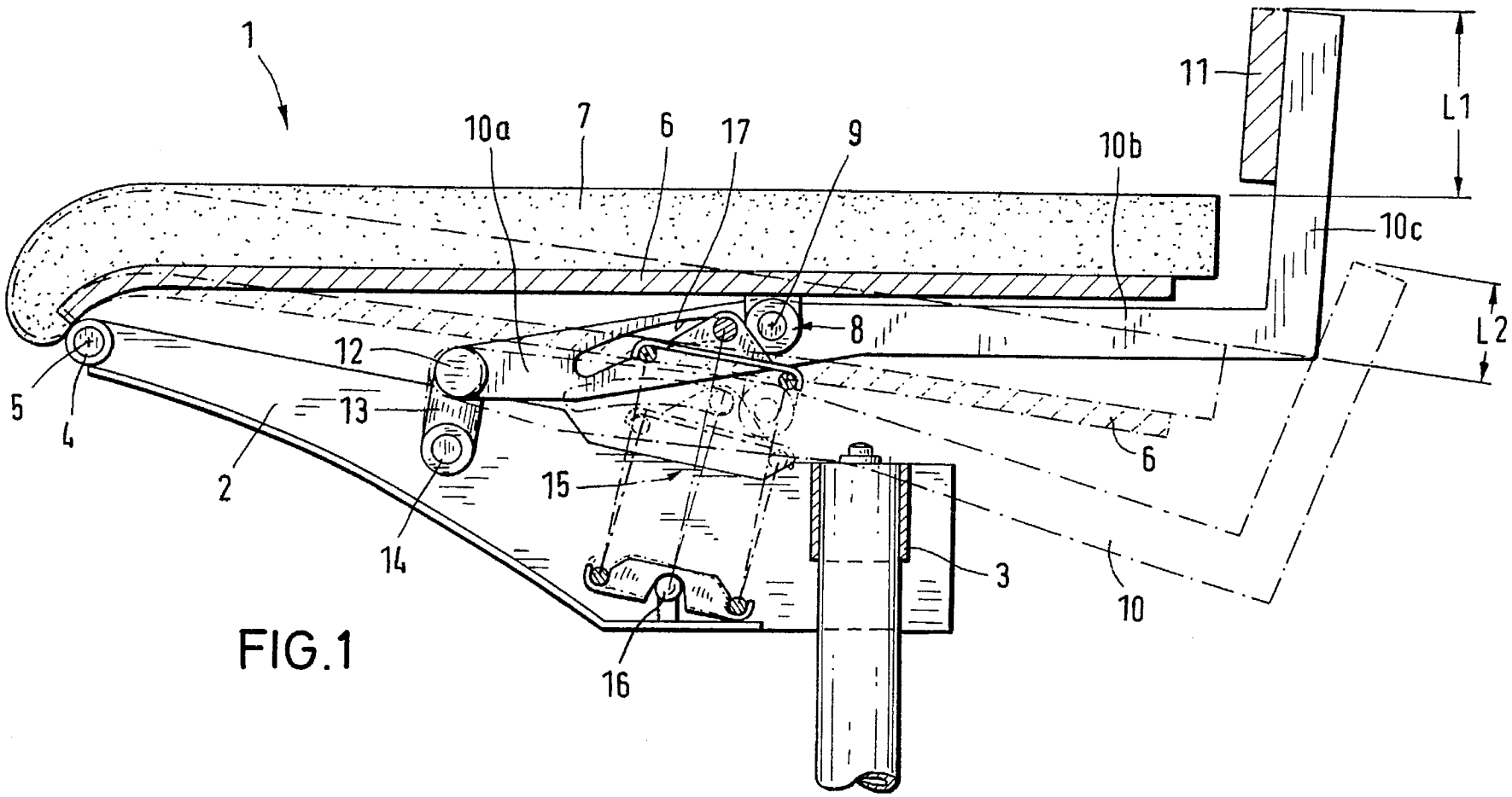

The invention is directed to a seat arrangement with a seat pivotable around a horizontal pivot axis in its front region and with variable inclination and with a backrest whose inclination can be changed compulsorily more than proportionally (super proportionally) in relationship to or as a function of the inclination change of the seat; herein the seat is pivotally connected to rocking levers. The rocking levers support the backrest with their respective ends. The respective ends of the rocking levers, opposite to the respective backrest supporting ends, are pivotally attached to the bearing block of the seat frame, wherein the rocking levers are articulated at the seat with spacing from the rear end of said seat; herein the segments of the rocking levers rotatably supported at the bearing block and the segments of the rocking levers adjacent to the articulation axis of the seat form an obtuse angle with the base; a return spring is also provided for automatic return of the seat surface and backrest from the neutral position into the working position when the load is removed.

Such seating facilities, in particular swiveling office chairs or professional work chairs of other types, are known in many embodiment forms, whereas one respectively always strives to achieve a synchronous movement of the seating surface and the backrest when pivoting the seat from the working position with a substantially horizontal seating surface and vertical backrest into the position of rest or the neutral position, for which purpose appropriate synchronization arrangements, for instance in the form of rocking levers are used. Herein the synchronization arrangement is laid out in such a way, that, when the seating surface is pivoted, a more than proportional (super proportional) pivoting of the backrest occurs, in order to attain a ergonomically favorable position of rest and to avoid the so-called "effect of removing one's shirt".

A seat of the generic type is known from the DE 39 16 474-A1. In this known seating chair the pivoting from the working position into the neutral position occurs by displacement of the weight of the user against a restoring or return device, which for instance is formed by a spring. Herein during the lowering motion the pivot axis of the seat at the bearing block is simultaneously guided to be falling-off in the rearward direction, for which purpose suitable elongated hole guides are provided in the bearing block.

In the first place it is disadvantageous in this known seat, that the displaceability of the pivot axis of the seat in the front region of the chair requires a relatively complicated or expensive design configuration, which requires a correspondingly space-consuming enclosure, which impairs the visual aspect of the chair. In the second place it is a considerable disadvantage, that the restoring or return-arrangement cannot be adapted to different weights of the user of the chair.

Basically it is for instance known from the DE 39 30 983-A1 to use a restoring arrangement consisting of at least one spherical spring effective in the pivoting mechanism. In this known seating arrangement, an arrangement for varying the prestress is provided for adaptation to different user weights and thus for adjustment of differing return or restoring forces.

An adjustment of the restoring device can be achieved indeed by this variation of the spring prestress, however it was seen that when the spring prestress is varied only an inadequate adjustment range within the limit ranges (for users with low or high body weights) is achieved. In addition either a very large adjustment travel or a considerable expenditure of force is required in the limit regions, which complicates the handling.

Therefore it is the task of the invention to create a solution where the handling of the restoring device is considerably improved and an adjustment with a low expenditure of force is made possible in a simple manner also in the limit regions, while at the same time providing as simple a design layout as possible and a small constructional size as well as a pleasant aspect of the seating arrangement.

The invention solves this task in a seating arrangement of the previously designated type by making the pivot axis of the rocker lever to be displaceable with respect to the bearing block, and by the restoring spring being disposed between the bearing block and the segments of the rocker levers rotatably supported at said bearing block; furthermore, the restoring spring in its installed position can be adjusted to be varied in such a way with respect to the pivot bearings, that the torque exerted by the spring force around the pivot axis is variable.

It is achieved first of all by the inventive design, that the synchronous movement required for the displaceability of the rocking levers does not require any additional constructional space in the front region of the seating arrangement, rather space is necessary only beneath in the bearing block proper, which results in only a small constructional space being required overall for the synchronization mechanism, which has a positive effect on the visual appearance. In the second place it is made possible by the disposition of the restoring spring in connection with this articulation of the rocking levers, to vary the installation position of the spring, so that the force application lever arm of the spring around the point of rotation of the pivot axes or rocking levers acted upon by the spring can be varied, whereby correspondingly the torque exerted upon the pivot axes can be changed in a simple manner. Thus no change of the prestress of the spring is necessary. This positional change of the spring or the spring end can be performed in a simple manner without exerting large forces, in particular an extraordinarily large band width of the users weight adjustment is available which can be selected in a stepless, continuous manner between the extreme values. Since the prestress of the spring is not affected, an adjustment within the limit regions is possible in a simple and accurate manner.

It is provided in an expedient embodiment of the invention, that the restoring spring is articulated or linked with one end fixedly at the bearing block and with the other end is displaceably arranged in an elongated hole-shaped guide of the rocking levers. This embodiment is particularly favorable and compact designwise, since it does not need any additional elements, rather the guides for changing the installation position of the spring are integrated directly into the rocking levers.

It is provided in an especially expedient version of the invention, that the return of the rocking levers is limited in such a way by a limitation device, that said rocking levers cannot come into contact with the bottom side of the seat. Differing for instance from the seating arrangements known from the DE 39 16 474-A1, it can be reliably avoided by this additional installation, that the rocking levers come into contact with the bottom side of the seat in the course of operation of the restoring device, so that they could possibly damage said seat bottom side if the restoring force is too large.

Herein it is expediently provided, that the limitation device is constituted by an elongated hole guide disposed at the bottom side of the pivot bearing, into which engages a pin-shaped element located at the bearing block. The elongated hole guide thus limits the maximum return pivot motion of the rocking levers due to its limited displaceability with respect to the pin-shaped element, which return movement is caused by the restoring force in such a way, that the rocking levers do not impact against the bottom side of the seat in the neutral position.

Figure 2:
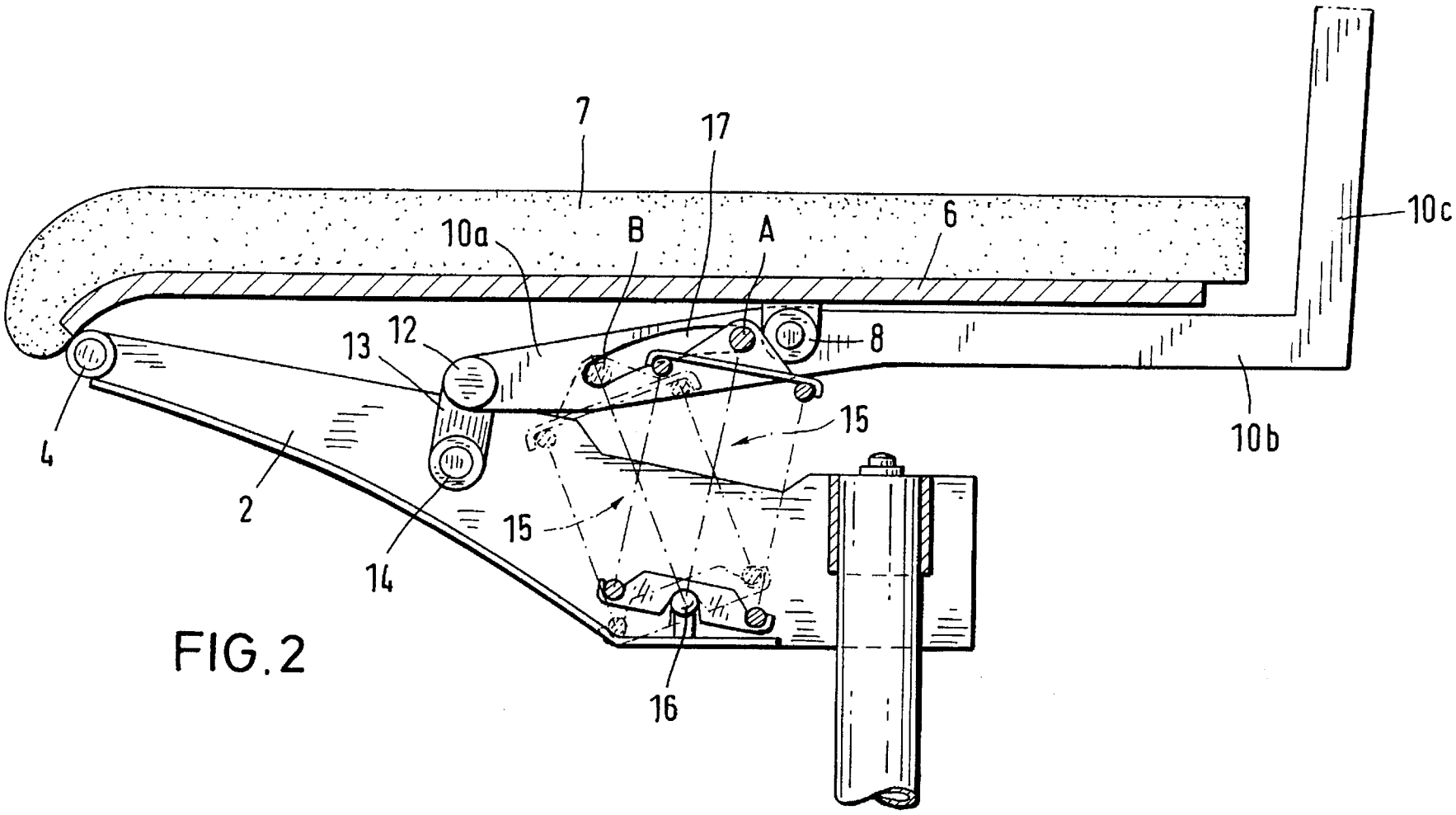
Figure 3:
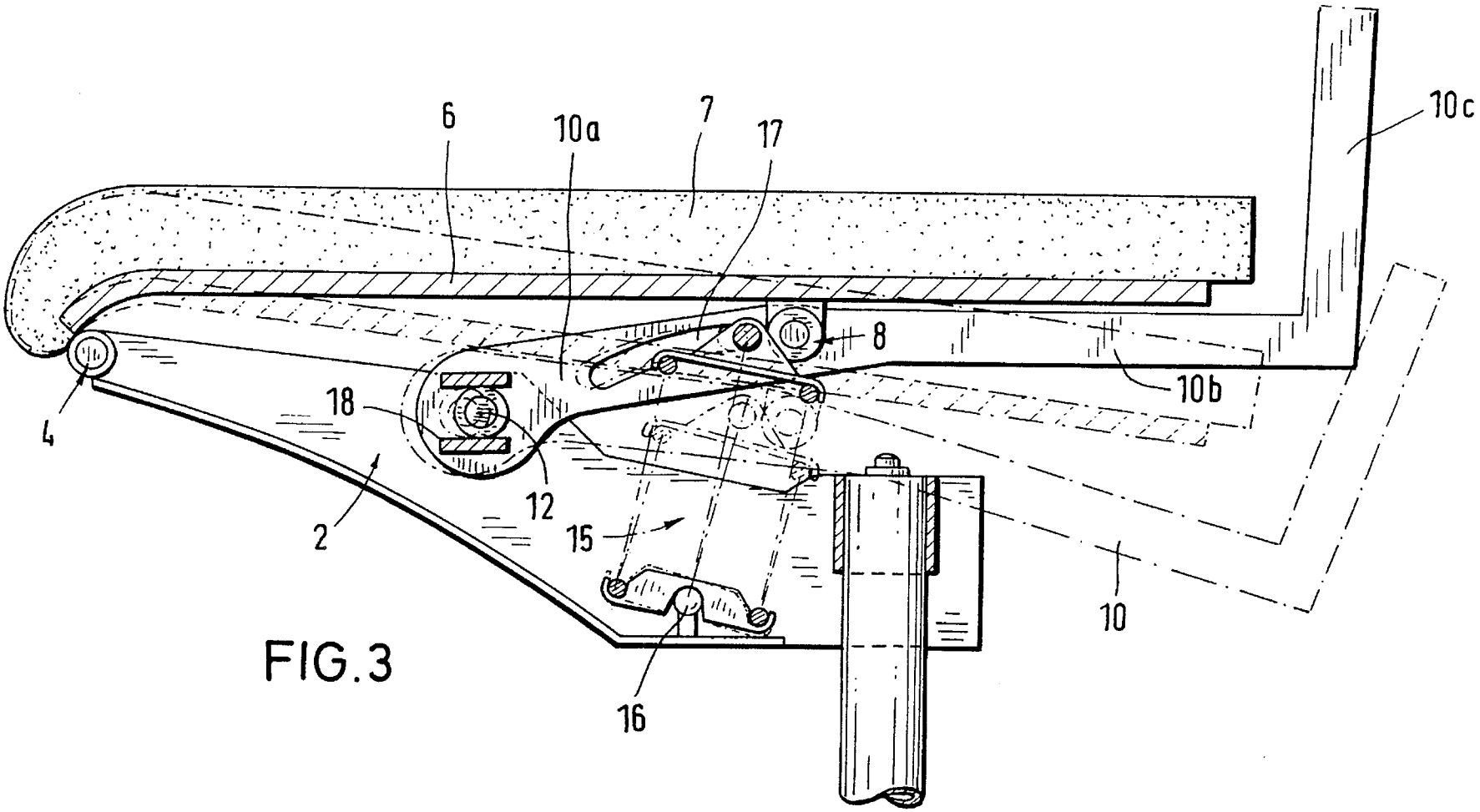
Figure 4:
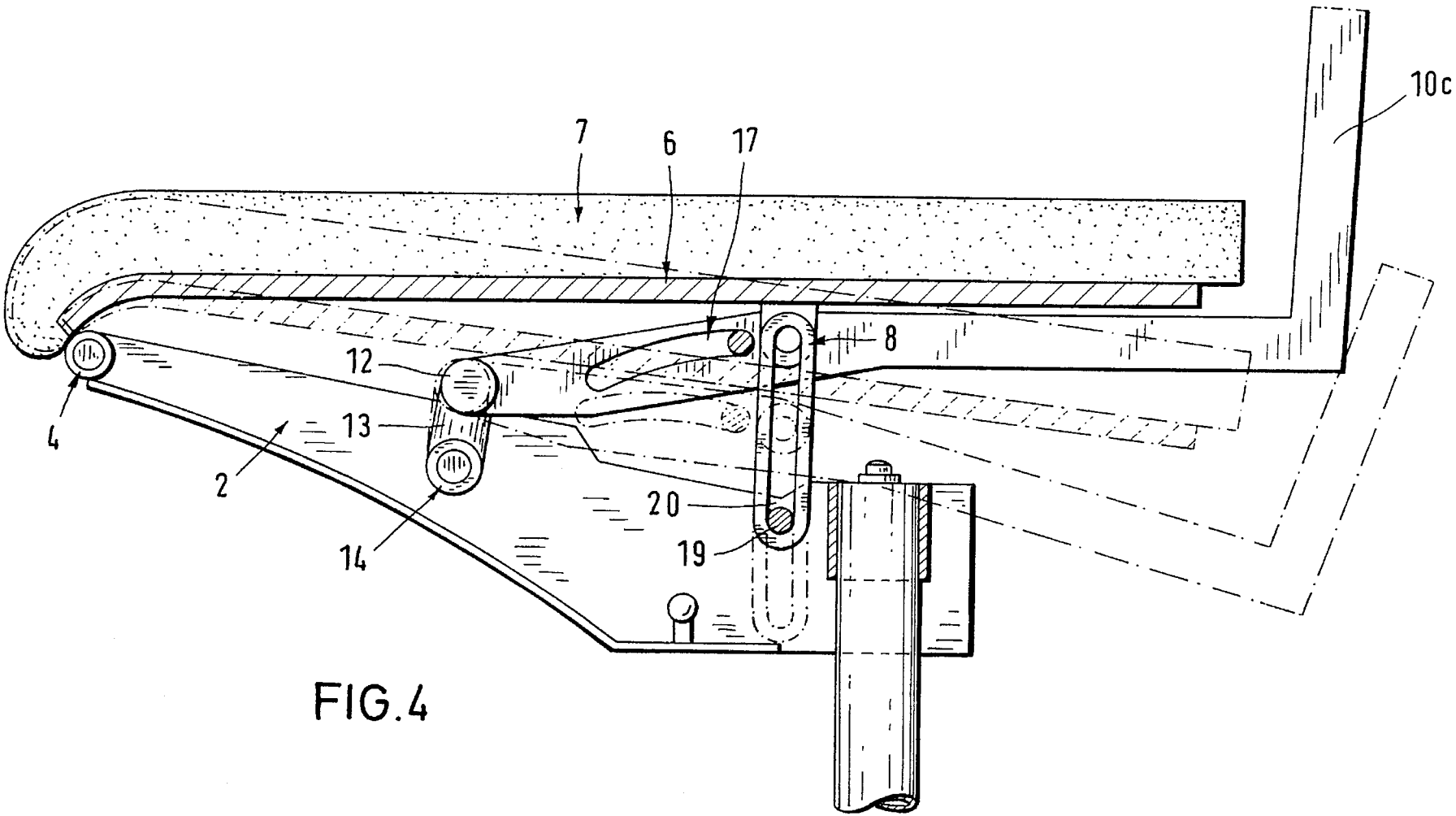
Figure 5:
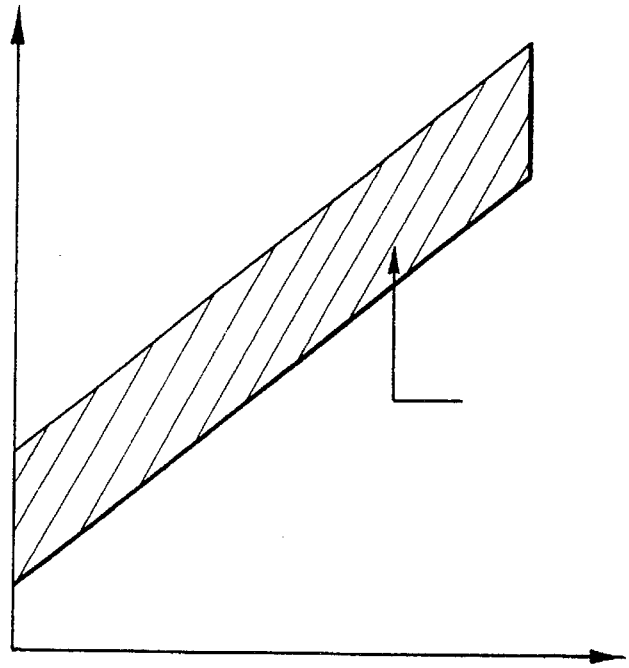
Figure 6:
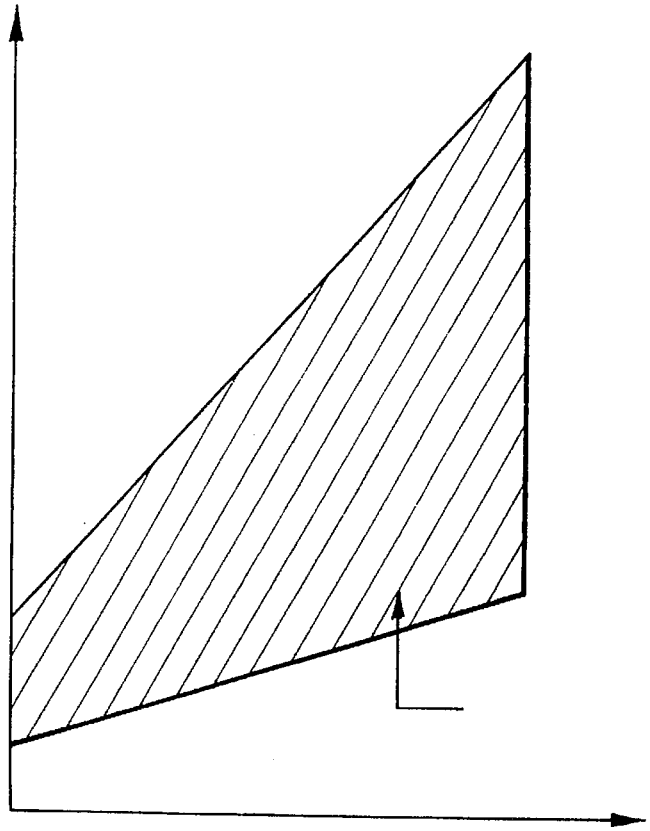

The invention is described with particularity in the following with the help of examples shown in the drawing. It is shown on:

FIG. 1 a seating arrangement in the invention in its working and neutral position with the restoring arrangement being completely effective, shown in diagrammatic side view, FIG. 2 a seating arrangement with a different position of the restoring arrangement than that shown as in FIG. 1, FIG. 3 a modified embodiment form of a seating arrangement presented the same way as in FIGS. 1 and 2, FIG. 4 a modified embodiment form of a seating arrangement with a limitation device for the restoring arrangement shown in the same way as in FIGS. 1 to 3, FIG. 5 a spring characteristic with conventional change of the prestress shown of a force-travel diagram and FIG. 6 a spring characteristic with the weight adaptation in the invention shown as of a force-travel diagram.

A seating arrangement in the invention preferably designed as a swivel chair is generally designated by the numeral 1 in the drawing and is shown without pedestal.

The swivel chair 1 comprises a bearing block 2 serving as support with a receptacle 3 for the pedestal not shown here. A fixed point of rotation 4 is provided at the front upper end of the bearing block 2, around which the front regional seat 6 with seating surface 7 is articulated around a horizontal pivot axis 5.

Two rocking levers 10 are articulated around a knuckle axis 9 in a rocking lever linkage 8 at the bottom side of the seat 6 somewhat behind the center of said seat; these rocking levers 10 comprise a front segment 10*a*, a center segment 10*b* and a rear segment 10*c*, wherein the rear segment 10*c* is disposed approximately at a right angle to the center segment 10*b* as well as carrying a backrest 11. The front segment 10*a* and the center segment 10*b* of the rocking levers 10 are disposed at an obtuse angle towards each other, preferably of an order of magnitude of 160° to 170°.

The segments 10*a* of the rocking levers 10 are connected each in an articulated manner (joint 12) with a respective one each lever 13, which is disposed at the bearing block 2 so as to be rotatable around a fixed point of rotation 14.

Due to this design there occurs a downward swiveling of the seat 2 around the swiveling or pivot axis 5, downward when there is a weight displacement of the user towards the rear, while at the same time a more than proportional change of inclination of the backrest 11 is performed because of the design of the rocking levers 10 together with the levers 13. This can be clearly seen from FIG. 1, because the spacing designated by L1 of the upper edge of the rocking levers 10 to the upper edge of the seat in the neutral position is clearly greater than the spacing in the lower position shown by a dotted line and designated with L2.

A restoring spring 15 is provided in order to assure an automatic return of the seat 2 and the backrest 11 from the lowered position into the neutral position when the weight is removed. This restoring spring 15 is linked with one end fixedly however rotatably (joint 16) to the bearing block 2 with the other end to the segments 10*a* of the rocking levers 10, wherein the installation position at the segments 10*a* of the rocking levers 10 is changeable. For this reason an arc-shaped elongated hole guide 17 is provided in the region of the segments 10*a* in the rocking levers 10.

As can best be seen from FIG. 2, the spring can thus be displaced in the elongated hole guide from the position A to the position B at a maximum. This entails that the torque exerted by the return spring 15 around the swivel axis 14 or 5 can be changed, in order to be able to attain a precise match of the restoring force to the different weights of the occupiers. While a maximum restoring force acts in position A, the restoring force in position B or the corresponding torque is at the lowest magnitude. This change of the lever arm or the torque exerted by the restoring spring enables a considerably better and more precise adjustability of the required restoring force, in particular also in the boundary regions, meaning for seating occupiers having a particularly high or low body weight, this compared to the conventional prestress changes of the restoring spring.

FIG. 3 shows a modified embodiment form of a seat arrangement 1 in the invention, while the same reference numbers as in FIGS. 1 and 2 are used provided they designate the same parts.

Differing from the embodiment form in FIGS. 1 and 2, the rocking levers 10 are not supported at the bearing block through additional levers 13, rather they are supported directly in the bearing block 2, wherein an elongated hole guide 18 is provided in the bearing block 2 in order to enable the rocking levers 10 to be displaced. Otherwise the motion sequence of the synchronous mechanism is retained as in the embodiment form in FIGS. 1 and 2; this embodiment form in FIG. 3 requires however, as is evident, even fewer components and is therefore even more advantageous.

The embodiment form of a seat arrangement 1 in the invention which is shown in FIG. 4 corresponds in principle to the embodiment form in FIG. 1; in this case also the same reference numbers as in the previous figures are used. However a limitation device is additionally provided for this seating arrangement 1, which limits the return of the rocking levers 10 in such a way, that said rocking levers 10 can no longer come into contact with the bottom side of the seat 2.

Herein the limitation device comprises a hoop- or stirrup-shaped elongated hole guide 20 at the bottom side of the rocking lever linkage 8, which cooperates with a pin-shaped element 19 located on the bearing block 2 and is guided so as to be displaceable to a limited degree with respect to said pin-shaped element 19. Herein the elongated hole guide 20 is designed in such a way, that a clearance remains at the stop of the elongated hole guide 20 against the pin-shaped element 19 between the rocking levers 10 or the regions 10*b* of the rocking levers and the bottom side of the seat 6 in a neutral position.

The effectiveness of the displacement of the restoring spring 15 can be seen in FIGS. 5 and 6.

While FIG. 5 shows a conventional adjustment by varying the prestressing force of the spring, the adjustment range by means of the inventive change of the installation position of the spring can be seen in FIG. 6. As it is discernible directly from FIGS. 5 and 6, the adjustment range of the inventive design (FIG. 6) is considerably larger, which greatly facilitates the adjustment especially in the limit regions.

Naturally the invention is not limited to the embodiment examples shown. Other embodiments of the invention are possible without leaving the basic thought thereof.

I claim:

1. A chair, comprising:

a bearing block;

a seat supported on the bearing block for pivotal movement about a horizontal pivot axis located in a front region of the seat, the seat having a variable inclination defined by a pivot position of the seat relative to the bearing block;

a backrest having a variable inclination corresponding to the variable inclination of the seat and pivotable upon a pivotal movement of the seat to a greater degree than the seat;

a pair of spaced rocking levers for pivoting the backrest upon the pivotal movement of the seat and having, respectively, first ends for supporting the backrest on the bearing block and second ends pivotally supported on the bearing block for pivotal movement about a common axis located in a variable position relative to the pivot axis of the seat, the rocking levers being pivotally connected to the seat at a location spaced from a rear end of the seat;

a return spring located between the bearing block and sections of the rocking levers extending between the second ends thereof and the location, at which the rocking levers are connected to the seat, for automatically returning the seat and the backrest from a working position to a neutral position upon removal of weight applied to the seat by acting on the rocking lever sections; and means for changing in the neutral position of the seat in which no weight is applied to the seat, a position of the return spring relative to the horizontal pivot axis of the seat for changing a returning torque applied by the return spring to the seat.

2. A chair according to claim 1, wherein the position changing means comprises a longitudinal guide opening, which is formed in the sections of the rocking levers extending between the second ends thereof and the location, at which the rocking levers are connected to the seat, and wherein the return spring has one end thereof secured to the bearing block and another end thereof located in the guide opening for displacement therealong.

3. A chair according to claim 1, further comprising means for limiting a return movement of the rocking levers so that the rocking levers would not contact a bottom side of the seat.

4. A chair, comprising:

a bearing block;

a seat supported on the bearing block for pivotal movement about a horizontal pivot axis located in a front region of the seat, the seat having a variable inclination defined by a pivot position of the seat relative to the bearing block;

a backrest having a variable inclination corresponding to the variable inclination of the seat and pivotable upon a pivotal movement of the seat to a greater degree than the seat;

a pair of spaced rocking levers for pivoting the backrest upon the pivotal movement of the seat and having, respectively, first ends for supporting the backrest on the bearing block and second ends pivotally supported on the bearing block for pivotal movement about a common axis located in a predetermined position relative to the pivot axis of the seat, the rocking levers being pivotally connected to the seat at a location spaced from a rear end of the seat;

a return spring located between the bearing block and sections of the rocking levers extending between the second ends thereof and the location, at which the rocking levers are connected to the seat, for automatically returning the seat and the backrest from a neutral position to a working position upon removal of weight applied to the seat by acting on the rocking lever sections;

means for changing a position of the return spring relative to the common axis for changing a returning torque applied by the return spring to the seat; and means for limiting a return movement of the rocking levers so that the rocking levers would not contact a bottom side of the seat;

wherein the chair comprises linkage means for pivotally connecting the rocking levers with the seat, and wherein the limiting means comprises an elongate guide hole formed in a bottom of the linkage means and a pin secured to the bearing block and extending into the guide hole.

* * * * *